United States Patent [19]

Moreno

[11] Patent Number: 4,751,757

[45] Date of Patent: Jun. 21, 1988

[54] WAVE DAMPENING DEVICE FOR USE IN A WATER BED

[75] Inventor: Carlos Moreno, Baldwin Park, Calif.

[73] Assignee: American Thermo Seal, Inc., Compton, Calif.

[21] Appl. No.: 60,949

[22] Filed: Jun. 11, 1987

Related U.S. Application Data

[62] Division of Ser. No. 861,565, May 9, 1986, abandoned.

[51] Int. Cl.[4] ..... A47C 27/08

[52] U.S. Cl. ..... 5/450; 5/451

[58] Field of Search ..... 5/451, 450, 452, 455, 5/422, 449; 428/166, 178

[56] References Cited

U.S. PATENT DOCUMENTS

| | | | |
|---|---|---|---|
| 2,171,805 | 9/1939 | Picard | 428/178 |
| 3,011,930 | 12/1961 | Dworak | 428/178 |
| 3,748,669 | 7/1973 | Warner | 5/450 |
| 4,076,872 | 2/1978 | Lewicki et al. | 5/455 |
| 4,296,510 | 10/1981 | Phillips | 5/450 |
| 4,399,575 | 8/1983 | Hall | 5/451 |
| 4,462,128 | 7/1984 | Labianco | 5/450 |
| 4,475,257 | 10/1984 | Phillips | 5/451 |
| 4,523,343 | 6/1985 | Fraige | 5/450 |
| 4,558,476 | 12/1985 | Linder | 5/451 |
| 4,577,356 | 3/1986 | Johenning et al. | 5/450 |
| 4,663,789 | 5/1987 | Smith | 5/451 |

FOREIGN PATENT DOCUMENTS

| | | | |
|---|---|---|---|
| 2099296 | 12/1982 | United Kingdom | 5/451 |

OTHER PUBLICATIONS

Del-Astra's "Royale" Waterbed, an ad in Flotation Sleep Industry Magazine, Sep. 1982 issue.

*Primary Examiner*—Alexander Grosz

*Attorney, Agent, or Firm*—Poms, Smith, Lande & Rose

[57] ABSTRACT

A water bed mattress made from a watertight envelope is shown having a pliable sheet of polyethelene with gas cells uniformly spaced throughout the pliable sheet in a grid-like pattern for supporting baffles that are attached to the pliable sheet by sewing.

11 Claims, 2 Drawing Sheets

WAVE DAMPENING DEVICE FOR USE IN A WATER BED

This is a division of application Ser. No. 861,565, filed May 9, 1986 now abandoned.

FIELD OF THE INVENTION

The present invention relates to an improved wave dampening device for use in a water bed and, more particularly, to a device for uniformly suspending wave dampening baffles throughout the water bed mattress.

BACKGROUND OF THE INVENTION

Water bed mattresses for supporting the weight of a sleeper have been well known and commercially available for some time. Such mattresses have been improved over the years to eliminate various problems including elimination of wave action when the user initially sits on, lays down, or rolls over on the mattress. This wave action has been eliminated by devices such as the use of a baffle to prevent the promulgation of a wave from one side of the mattress to the other. Another approach is to fill the mattress with polyester fiber which is formed into relatively thin sheets and stacked within the watertight envelope that forms the mattress. Yet another approach is to use open cell foam in sheets which are also placed within the vinyl mattress envelope.

One problem with using vinyl baffles is created by the difficulty in retaining them in an equal spacing throughout the envelope which forms the mattress. The problem with open cell foam or polyester fiber is that the water or other liquid contained within the mattress eventually breaks down the fiber or foam, allowing the water to penetrate the flotation bubbles formed therein. This causes the material which forms the fiber or foam to lose its bouyancy and concentrate along the lower surfaces of the envelope for reducing the baffle-like effect of the fiber or foam. Such concentration renders the material useless as a wave dampening device.

Some prior devices use foam material to float the vinyl baffles. While this arrangement has some advantages, it is also subjected to the eventual deterioration of the foam material as mentioned above.

Accordingly, it is the object of the present invention to provide an improved wave dampening device for a water bed which is not susceptible to deterioration in the presence of the water contained therein.

Another object of the present invention is to provide a flotation member that is non-permeable to the liquid of the water bed for floating the baffles used to dampen a wave action therein.

SUMMARY OF THE INVENTION

In accomplishing these and other objects a water bed mattress is provided having a liquid-tight envelope which is generally supported within a frame placed upon the floor of a dwelling. Contained within the envelope is a pliable sheet having a plurality of gas cells formed within the sheet in a grid-like pattern. The pliable sheet is constructed of a material that is resistant to deterioration caused by the liquid contained within the mattress envelope. Because of the gas cells, the pliable sheet floats to the upper surface of the water bed mattress and is retained against that mattress surface. Suspended from the pliable sheet are a plurality of baffles which extend to the lower surface of the envelope and completely fill the volume thereof.

DESCRIPTION OF THE DRAWINGS

A better understanding of the invention briefly described above and of its objects will be had after careful consideration of the following specifications and drawings, wherein.

DETAILED DESCRIPTION OF THE PREFERRED EMBODIMENTS

Figure 1:
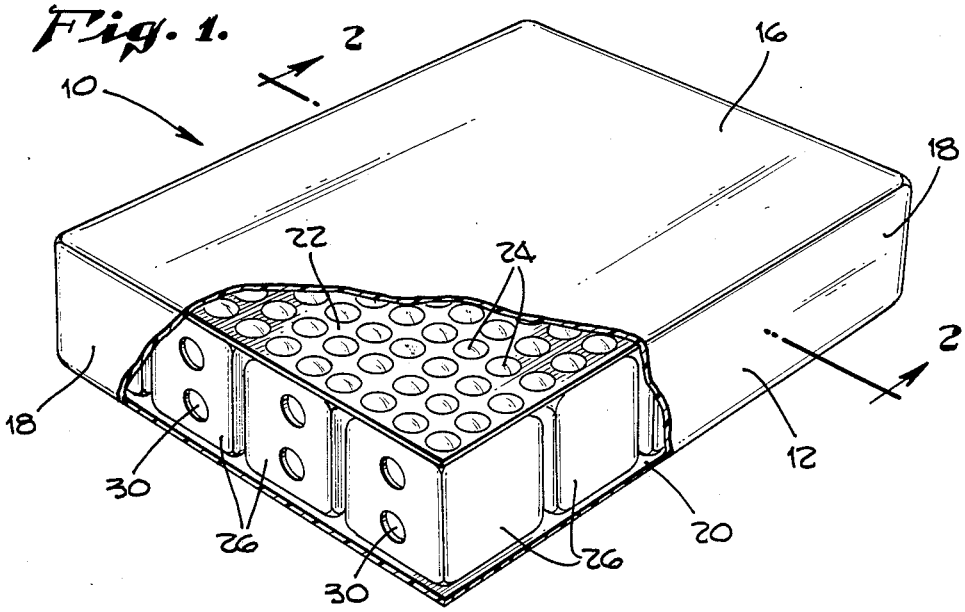
FIG. 1 is a perspective view shown partially in section revealing the pliable sheet and suspended baffles of the present invention.

Referring now to the drawings, FIG. 1 shows a water bed mattress 10 formed from an envelope 12 which may be constructed from any suitable, flexible material such as polyvinylchloride. The envelope 12 may be sealed by heat welding or adhesive bonding to hold a liquid 14, generally water. Envelope 12 consists of an upper surface 16 which is generally rectangular in shape having four side walls 18 extending down and enclosed by a lower surface 20. The rectangular volume thus formed is retained in a frame, not shown, and provided with an inlet/outlet valve, not shown, for filling with liquid 14.

Located within envelope 12 is a single, pliable sheet 22 having a plurality of gas cells 24 arranged in a uniform grid pattern across the surface thereof. These gas cells may be filled with any suitable gas; however, in the preferred embodiment, the gas cells are filled with air. The gas cells 24 may be formed within sheet 22 by one of several processes. Air may be injected between the outer surfaces of the sheet after the sheet is heated to a desired resilient state. Alternately, the gas cells may be formed by heat welding or adhesive bonding two pliable sheets 22 together with air spaces formed therebetween. In another arrangement, the gas cells may be formed by placing a pliable sheet 22 over a suitable mold having a plurality of cavities therein. Hot gas under pressure may then be introduced over the surface of the pliable sheet opposite the cavities for deforming the sheet into each cavity. Thereafter, a second sheet may be bonded to the deformed, first sheet to form the gas cells 24. In the preferred embodiment, the material which comprises the pliable sheet 22 is selected to be relatively strong and resistent to water or other liquid deterioration. Such material may include polyethelene. Further, the material is selected to permit stitching so that baffles 26 may be attached thereto.

Figure 2:
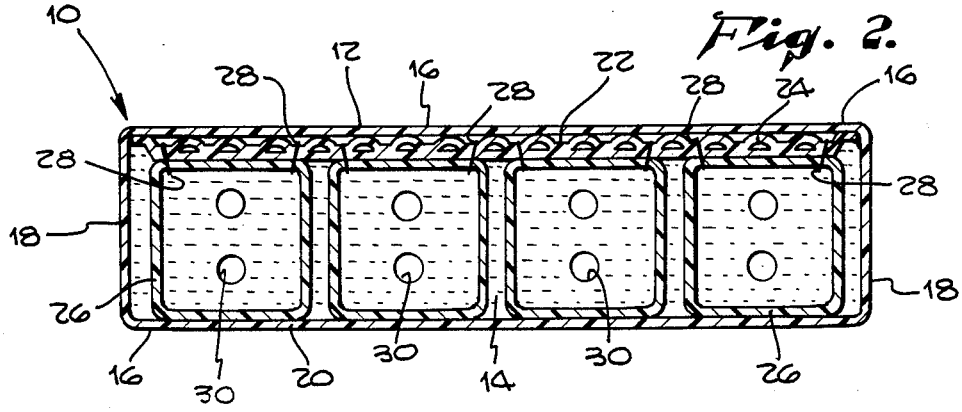
FIG. 2 is a cross-sectional view taken along line 2—2 of FIG. 1.

Referring now to FIG. 2, the arrangement of a plurality of baffles 26 is shown in greater detail. It will be noted that the baffles 26 are attached to the pliable sheet 22 by sewing a continuous thread 28 through the sheet 22 and each baffle 26. Other means for connecting the baffles 26 include adhesive bonding or stapling. Because the baffles 26 are generally constructed from polyvinylchloride, in the preferred embodiment, heat welding is not a desirable manner of attachment due to the differences in material with the pliable sheet 22. Further, because of the configuration of the baffles, to be described below, it will be understood that heat welding is not desirable due to the difficulty in supporting the upper surface of the baffles 26 against the pliable sheet 22.

The liquid tight envelope shown in FIGS. 1 and 2 may take any desired form, not necessarily rectangular. However, in one embodiment, a king size mattress is constructed which is typically 6 feet wide by 7 feet long and 9 inches high. In such an arrangement, the baffles 26 are formed as generally cubical containers having a dimension of 12 inches square along the upper surface and a height of 9 to 12 inches. Because the material of the baffle containers 26 is slightly denser than the liquid 14, the baffles tend naturally to sink to the bottom surface 20 of envelope 12 with the upper surfaces thereof floatably supported by the pliable sheet 22. Relatively large apertures 30 are placed within at least two side walls of the baffle containers 26 to permit the easy flow of liquid 14 in and out of the containers. It is not the purpose of the present invention to provide small apertures, thus forcing the baffle containers 26 to become hydraulic-like pistons when a user sits or lays upon the mattress 10. The reason for this is that such hydraulic-like action tends to stretch the material that forms the containers and will eventually rupture the containers.

The mattress shown in FIG. 2, if a king-size mattress, would typically contain forty-two 12×12 inch baffles. Thus, it will be understood that the baffles 26 shown in FIG. 2 are normally touching one another in the preferred embodiment. The baffles have been shown spaced apart for purposes of illustration. In a semi-waveless mattress, twelve baffles may be used. Further, other mattresses may use eighteen, twenty-four, or any suitable number of baffles 26.

Figure 3:
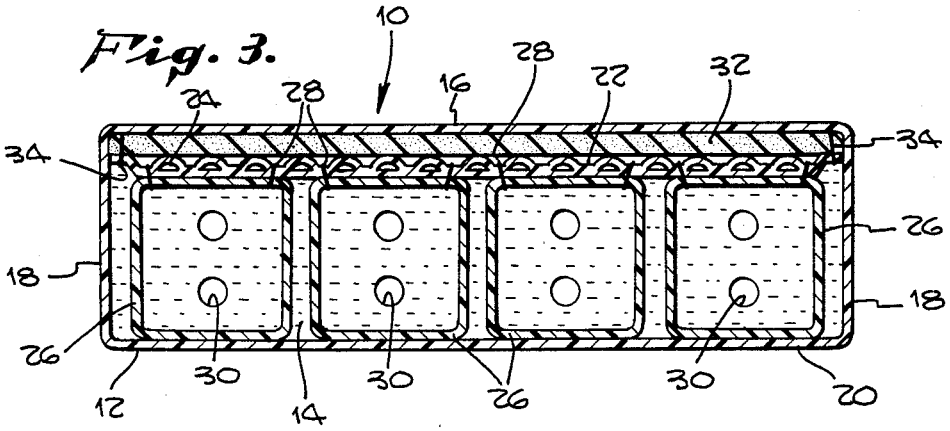
FIG. 3 is a cross-sectional view similar to FIG. 2 showing a modification of the invention disclosed in FIGS. 1 and 2.

Referring now to FIG. 3, another embodiment of the present invention is shown in which a resilient pad 32 is shown mounted between the pliable sheet 22 and the upper surfaces 16 of the flexible envelope 12. It will be observed that the pad 32 does not need to be attached to the pliable sheet 22 as the flotation of sheet 22 will retain the pad in the position shown. Further the pad, in the preferred embodiment, is constructed from polyester fibers which float in the liquid 14. However, in the preferred embodiment, the pad 32 is attached at least along its outer perimeter by sewing a second thread 34 between the pad 32 and pliable sheet 32. Attachment may also be accomplished by bonding.

Figure 4:
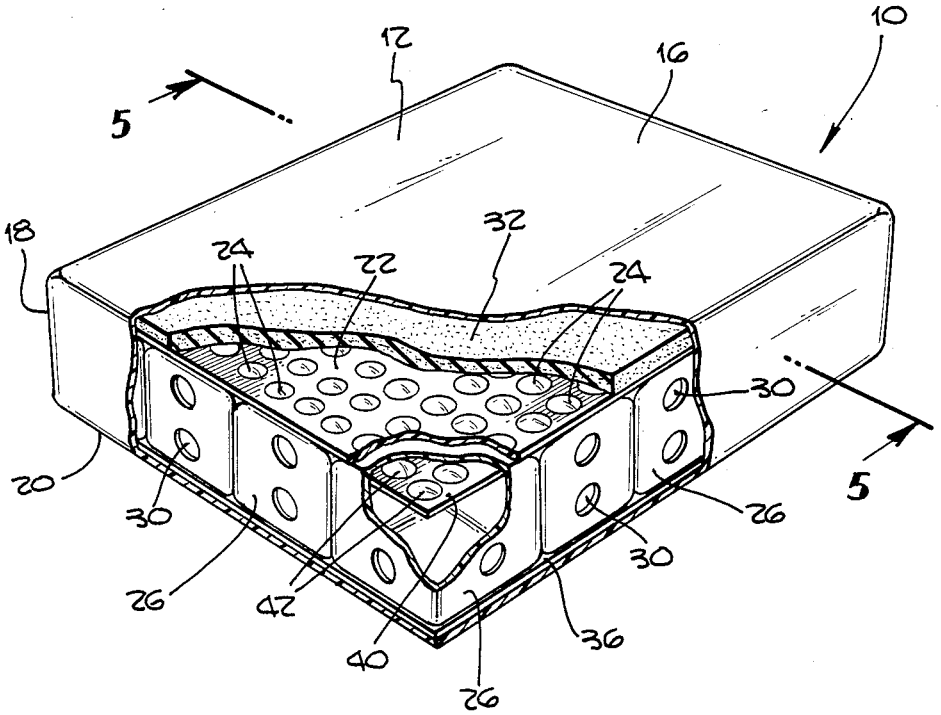
FIG. 4 is a perspective view similar to FIG. 1 showing a further modification of the present invention.
Figure 5:
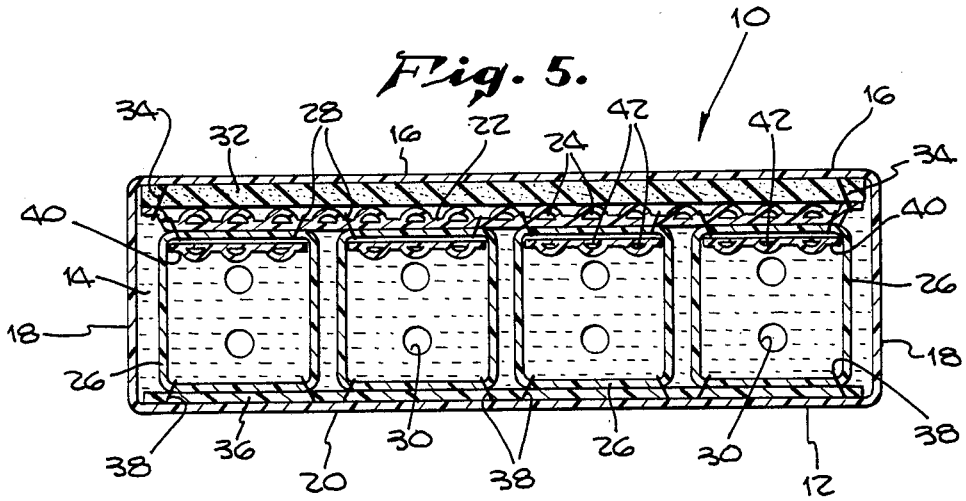
FIG. 5 is a cross-sectional view taken along line 5—5 of FIG. 4.

A further embodiment of the preferred invention is shown in FIGS. 4 and 5 wherein the flexible envelope 12 contains the pliable sheet 22 and a plurality of baffles 26 attached thereto by thread 28 and extending down through the envelope 18 to the lower surface 20 thereof. To assist the retention of the baffles 26 against the lower surface 20, a second flexible bottom sheet 36 has been added within the envelope 12. Each baffle 26 is attached to the second bottom sheet 36 as by sewing a continuous thread 38 between the sheet 36 and baffle 26. The reader will understand that sewing is not detrimental to the water bed mattress 10 since the wave dampening device formed by the pliable sheet 22, baffles 26, and (in one embodiment) bottom sheet 36 is fully contained within the envelope 12. Thus, any holes in these elements will not affect the watertight feature required by envelope 12. This is important as sewing is a relatively simple and inexpensive way of joining the components of the improved water bed 10. Since the bottom sheet 36 is made of polyvinylchloride, in the preferred embodiment, it may also be attached to baffle 26 by heat welding in addition to sewing, adhesive bonding, or stapling.

The embodiment shown in FIGS. 4 and 5 is further improved by the introduction of individual pliable sheets 40 into each baffle container 26. Each of the pliable sheets 40 include a plurality of gas cells 42 to assure the floatation of sheets 40. In the embodiment shown in FIG. 5, the mattress 10 is made firmer by the introduction of the plurality of pliable sheets 40. The still firmer mattress may be formed by adding an additional pliable sheet 22. In that, in the preferred embodiment, two sheets 22 are utilized.

The embodiments of the present invention include several modifications, as described above. It will be understood that other variations are possible within the concept of utilizing a pliable sheet having gas cells therein for flotation for a wave dampening device. Accordingly, the invention should be limited only by the appended claims.

I claim:

1. A water bed mattress structure, comprising:

a liquid tight envelope formed from flexible sheet material having an upper surface for supporting the weight of a user;

a single pliable sheet disposed within said envelope having a shape that generally conforms to the shape of said upper surface of said envelope, said single pliable sheet having a plurality of gas cells arranged in uniform rows in a uniform grid pattern adapted to float said single sheet in the liquid intended for use in said envelope, said gas cells arranged in said uniform grid pattern to control the firmness of said mattress;

apertured, container-like baffles attached to the bottom of said single pliable sheet; and continuous, individual pliable sheets positioned inside some of said baffles, said individual pliable sheets having a plurality of gas cells arranged in uniform rows in a uniform grid pattern adapted to float said individual pliable sheets in the liquid intended for use in said envelope, whereby said individual pliable sheets increase the firmness of said mattress.

2. The mattress defined in claim 1 further comprising:

a pad positioned between said single pliable sheet and said upper surface of said envelope.

3. The mattress defined in claim 1 further comprising:

a pad attached to the bottom of said baffles and adapted to sink said baffles in said liquid, whereby said baffles are extended within said envelope between said single pliable sheet and said sinking pad.

4. The mattress defined in claim 3 wherein the bottom pad is attached to said baffles with adhesive.

5. The mattress defined in claim 3 wherein the bottom pad is attached to the bottom of the baffles with staples.

6. The mattress defined in claim 3 wherein the bottom pad is attached to the bottom of the baffles with stitches.

7. The mattress defined in claim 3 further comprising:

a pad positioned between said single pliable sheet and said upper surface of said envelope.

8. The mattress defined in claim 1 further comprising:

an additional pliable sheet positioned above said single pliable sheet having a shape that generally conforms to said single pliable sheet, said additional pliable sheet having a plurality of gas cells arranged in uniform rows in a uniform grid pattern adapted to float said additional pliable sheet in the liquid intended for use in said envelope, whereby said additional pliable sheet increases the firmness of said mattress.

9. The mattress defined in claim 8 further comprising:

a pad positioned between said additional pliable sheet and said upper surface of said envelope.

10. The mattress defined in claim 8 further comprising:

a pad attached to the bottom of said baffles and adapted to sink said baffles in said liquid, whereby said baffles are extended within said envelope between said single pliable sheet and said sinking pad.

11. The mattress defined in claim 10 further comprising:

a pad positioned between said additional pliable sheet and said upper surface of said envelope.

* * * * *